United States Patent [19]

Van Cleve

[11] 4,208,791

[45] Jun. 24, 1980

[54] ARCUATE RAZOR HEAD

[76] Inventor: Barbara J. Van Cleve, 2155 W. Farmdale #2, Mesa, Ariz. 85202

[21] Appl. No.: 8,282

[22] Filed: Feb. 1, 1979

[51] Int. Cl.[2] ..... B26B 21/22; B26B 21/06

[52] U.S. Cl. ..... 30/49; 30/50; 30/346.58

[58] Field of Search ..... 30/49, 50, 172, 299, 30/303, 317, 346.58, 353, 356

[56] References Cited

U.S. PATENT DOCUMENTS

| | | | |
|---|---|---|---|
| 1,308,730 | 7/1919 | Benn | 30/49 |
| 1,324,010 | 12/1919 | Hyman | 30/49 |
| 1,961,132 | 6/1934 | Behrman | 30/49 |
| 1,974,568 | 9/1934 | Grotenhurs | 30/49 X |

FOREIGN PATENT DOCUMENTS

| | | | |
|---|---|---|---|
| 619119 | 3/1949 | United Kingdom | 30/49 |

*Primary Examiner*—Gary L. Smith

*Attorney, Agent, or Firm*—Drummond and Nelson

[57] ABSTRACT

An arcuate razor head is shaped to conform to convex and concave body surfaces. Cutting edges are emplaced in inclined arcuate surfaces, one above the other. The inclined surfaces guide the cutting edges at an efficient cutting angle as the razor head is drawn over the surface of the body being shaved. The inclined surfaces intersect in a line removed from the location of the cutting edges. Both convex and concave arcuate cutting edges are immediately available to the user.

1 Claim, 5 Drawing Figures

ARCUATE RAZOR HEAD

This invention relates to razor heads for use on the arm, leg, and underarm regions of the body.

More particularly this invention relates to a razor head having both concave and convex arcuate cutting edges.

Even more specifically this invention relates to razor heads having both concave and convex arcuate cutting edges, each supported one above the other, and each available for immediate use.

This invention relates to arcuate cutting edges such as would result from the bowing of a common straight edge safety razor blade. It specifically does not relate to the type of arcuate edge which would result by introducing a curved edge lying within the plane of such a safety razor blade.

Because excessive body hair has often been considered unsightly, the prior art is replete with suggested shapes for razors, which shapes would hopefully simplify the process of removing body hair from curved surfaces of the body, while making the process safer for the user. Many such innovations required razor blades of non-standard shape. Typical of such approaches are the 1919 U.S. Pat. No. 1,324,010, issued to Hyman et al and the 1930 U.S. Pat. No. 1,961,132, issued to Behrman.

Other innovators provided clamping devices which accepted standard razor blades and distorted them in such a manner as to provide arcuate cutting edges for presentation to the various curved surfaces of the body, As examples, see the patents of Zumwalt, U.S. Pat. No. 1,821,825; Bradbury, U.S. Pat. No. 1,947,244; Ohmer, U.S. Pat. No. 2,008,591; and Stewart, U.S. Pat. No. 2,545,533. Of these, those of Zumwalt and Ohmer are most interesting since each provided the choice of either convex or concave cutting edge on their shaving impliment as the user might require. However, it was required that the razor head be dismantled in order to convert it from one arcuate shape to the other.

Bradbury provided a razor head which enabled the user to distort a standard double-edge safety razor blade so as to maintain one edge essentially straight while the remaining edge was clampled into arcuate form. Both edges were immediately available to the user without the need to dismantle the shaving head. However, the shape of the razor head is established by the necessity to avoid fracturing the razor blade when it is clamped in its distorted configuration. The razor head surfaces are not designed to aid the user in establishing the proper angle at which the instrument is to be held against the body surface being shaved.

It is therefore an object of the present invention to provide an arcuate razor head which overcomes the disadvantages of prior art devices.

It is a particular object of the present invention to provide a razor head having both convex and concave arcuate cutting edges immediately available to the user without having to modify the razor head.

It is a specific object of the invention to provide a razor head having surfaces which aid the user in establishing the proper cutting angle at which to draw said razor head across the body surface being shaved.

It is a further object of the invention that the razor head be so relatively inexpensive to manufacture and to purchase that it my be discarded after using.

In summary, the invention is comprised of a molded razor head having two arcuate surfaces. At a leading edge of each of said arcuate surfaces, a razor cutting edge is disposed in conformance with the arc thereof. Each surface is inclined so as to properly position its associated cutting edge for efficient removal of bodily hair growth as the razor head is drawn across the body surface. The surfaces are disposed, one above the other; and the result of their inclination is to cause said surfaces, if extended, to intersect in a line at some distance removed from the edge at which said razor cutting edges are emplaced. The surfaces are arcuate to the extent that one of said surfaces conforms comfortably to concave surfaces of the body to be shaved, such as the underarms and the regions about the knee and ankle. The remaining one of said surfaces is arcuate to permit it to conform to convex shaped body surfaces, such as the legs and arms.

The invention will be better understood after a review of the following detailed description and the accompanying illustrations, of which FIG. 1 is a perspective view of the razor head with a handle which may be used to manipulate the razor.

Figure 1:
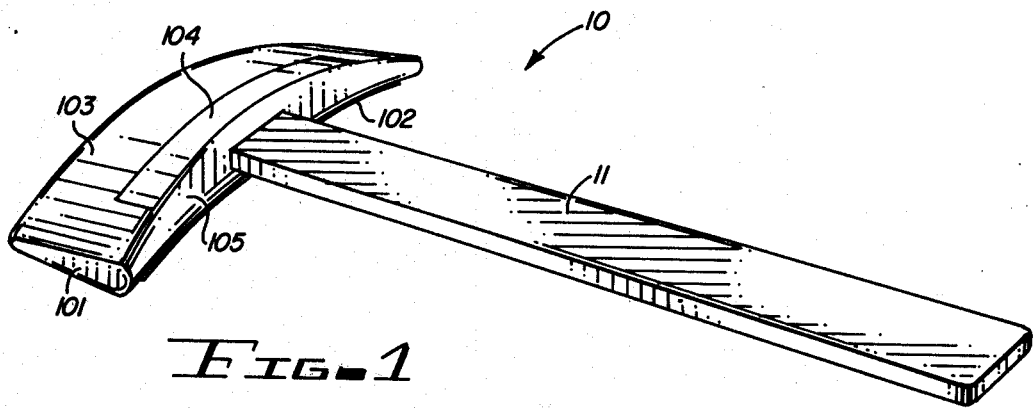

The simplicity of the invention is seen in the embodiment illustrated in FIG. 1 in which razor head 10 is disposed with concave arcuate surface 101 down as it would be when used to shave convex body surfaces, such as the arms and legs. In use, razor head 10 is drawn in the direction of handle 11 with surface 101 maintained in contact with the body surface to be shaved. A razor edge 102 is emplaced as indicated in the leading edge of surface 101 and conforming to its arcuate contour. Maintaining surface 101 in contact with the body surface, position cutting edge 102 to efficiently remove any bodily hair growth present.

The length of the cutting edge of a standard safety razor blade has evolved over the years to efficiently meet the demands of males who regularly shave their faces to remove hair growth from cheeks, chin and neck. The length of the conventional razor blade appears amply suited to that purpose. However the length of the cutting edge used to remove hair from the arms and legs may be effectively increased beyond that considered standard for todays safety razor blades. For example, by way of illustration and by no means limitation, blade 102 of the present invention may have an effective cutting edge length on the order of fifty-four to sixty mm. The utility of the invention is thus enhanced by the increased effective cutting length of blade 102.

Figure 3:
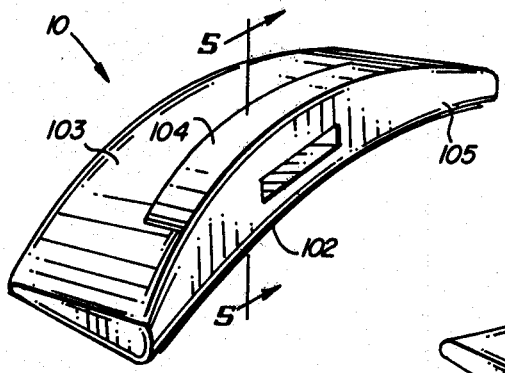
FIG. 3 is a perspective view of the razor head indicating the placement of the razor cutting edges in the convex arcuate surface.
Figure 4:
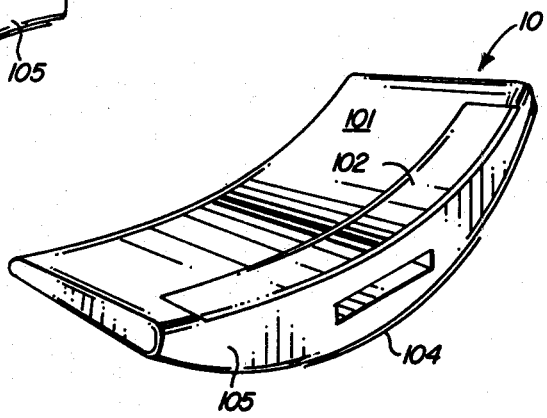
FIG. 4 is a perspective view of the razor head indicating the placement of the razor cutting edges in the concave arcuate surface. Comparison of FIGS. 3 and 4 makes clear that the length of the razor edges in the concave arcuate surface are longer to more efficiently shave the broad surfaces of the arms and legs.

Since like reference characters have been used to represent identical elements in FIGS. 1 through 5 and understanding of the details of the foregoing discussion may be better understood by referring also to FIG. 4.

With particular reference to FIGS. 1 and 3 the upper surface 103 is seen to be convex arcuate in shape. This shape permits the razor head 10 to conform comfortably to concave body surfaces such as the underarm, ankle, and knee regions. In the leading edge of arcuate surface 103 is emplaced cutting edge 104 which conforms to the arc thereof. Because of the characteristics of the body surfaces to which razor edge 104 is adapted the cutting length of edge 104 is more nearly that of the length of the standard safety razor blade. For example, and again without attempting to limit the invention, a cutting length of approximately thirty-six mm may be utilized.

No manufacturing problems are introduced by providing cutting edges 102 and 104 each of different lengths, since present day manufacturing techniques produce such razor cutting edges as one continuous strip from which the selected length cutting edges are later cut.

Figure 5:
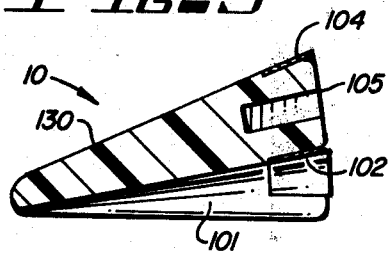
FIG. 5 is a sectional view of the razor head depicted in FIG. 3.
Figure 2:
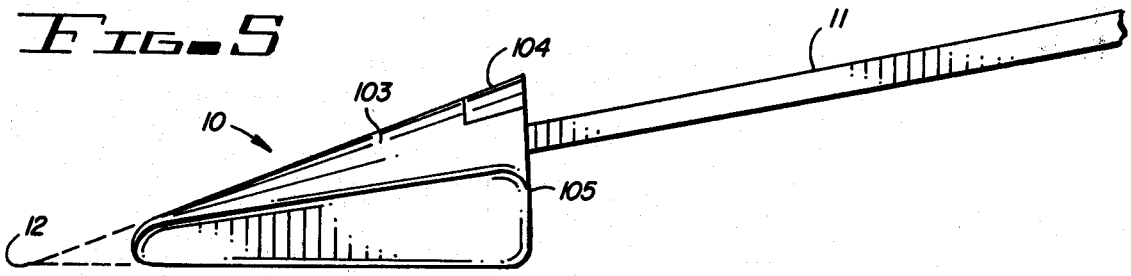
FIG. 2 is a side elevation of the razor of FIG. 1. The phantom lines indicate that the top and bottom surfaces, if extended, would intersect in a line at a distance removed from the cutting edges.

FIG. 5 is a sectional view of razor head 10 as depicted in FIG. 3. In this sectional view the emplacement of razor cutting edges 102 and 104 is made clear. Although only a single cutting head is shown and placed in each of surfaces 101 and 103, no limitation is emplaced on the invention thereby. The present day practice of molding double cutting edges into a razor head may be as effectively utilized with the invention as it has been with prior art. The leading edges of razor head 10 are defined as those edges closest to the face at which the handle is emplaced. As is made obvious in FIG. 5 and depicted in phantom view in FIG. 2 a single tailing edge would result if the surfaces 103 and 101 were extended. The intersection of arcuate surfaces 101 and 103 would be along a line which would pass through point 12 indicated in FIG. 2. This intersection comes about because the arcuate surfaces 101 and 103 are inclined with respect to each other. This mutual inclination permits the placement of handle 11 in face 105 in the manner depicted which enables the user to maintain either surface 101 or 103 in contact with the body surface being shaved and to simultaneously draw the razor in the general direction of handle 11 so that cutting edge 102 or 104 is guided to efficiently remove bodily hair growth. The user of the invention has immediate access to either cutting edge 102 or 104 by simple rotation of the razor head handle in the users hand. No bothersome dismantling and reassembly of the razor head is required.

What I have described is an arcuate razor head having curved surfaces which conform comfortably to both concave and convex body surfaces. The concave and convex body surfaces of the razor head are inclined with respect to each other so as to properly position the razor cutting edges with respect to the body surface being shaved, and to permit the placement of a razor head handle for efficient operation of the razor head. Cost effective manufacturing techniques such as molding are suggested so as to minimize manufacturing costs of the invention. Such suggestions of course are not intended to limit the use of the invention.

Having described my invention, and illustrating it as well, both in such detail and clarity as to enable those skilled in the art to practice the invention, that which I claim as my invention is:

1. A razor for the removal of body hair from arms, legs, underarms and the like comprising:

a razor head having upper and lower arcuate surfaces, the extensions of which surfaces intersect in a line, said upper surface conforming comfortably to concave surfaces of the body and said lower surface conforming comfortably to convex body surfaces; and at least one razor cutting edge emplaced in each of said upper and lower arcuate surfaces, conforming to the arcuate shape thereof and removed from the line at which the extension of said surfaces intersect, such that, when either one of said surfaces is drawn across a conforming body surface, bodily hair growth there existing is removed by said cutting edge.

* * * * *